US006135025A

United States Patent [19]

Zimmer

[11] Patent Number: 6,135,025

[45] **Date of Patent: *Oct. 24, 2000**

[54] PROCESS AND DEVICE FOR CLEANING AN APPLICATION DEVICE

[76] Inventor: Johannes Zimmer, Ebentaler Strasse 133, A-9020 Klagenfurt, Austria

[ * ] Notice: This patent is subject to a terminal disclaimer.

[21] Appl. No.: 09/134,726

[22] Filed: Aug. 15, 1998

Related U.S. Application Data

[62] Continuation-in-part of application No. 08/693,159, Aug. 9, 1996, abandoned, which is a continuation-in-part of application No. 08/532,634, filed as application No. PCT/AT95/00030, Feb. 13, 1995, Pat. No. 5,775,218.

[30] Foreign Application Priority Data

| | | | |
|---|---|---|---|
| Feb. 12, 1994 | [WO] | WIPO | PCT/EP94/0419 |
| Dec. 12, 1994 | [AT] | Austria | 2303/94 |
| Feb. 13, 1995 | [WO] | WIPO | PCT/AT950030 |

[51] Int. Cl.[7] ..... B41M 1/12; B41F 35/04

[52] U.S. Cl. ..... 101/129; 101/425; 101/483

[58] Field of Search ..... 101/119, 120, 101/424, 425, 129, 114, 483; 68/200; 134/22.1, 22.11, 22.12, 22.18

[56] References Cited

U.S. PATENT DOCUMENTS

| | | | |
|---|---|---|---|
| 4,436,032 | 3/1984 | Van Ouwerkerk | 101/120 |
| 4,665,723 | 5/1987 | Zimmer | 101/120 |
| 5,099,758 | 3/1992 | Hassler et al. | 101/120 |
| 5,680,817 | 10/1997 | Fontana | 101/424 |
| 5,775,218 | 7/1998 | Zimmer | 101/120 |
| 5,915,302 | 6/1999 | Baba et al. | 101/425 |

FOREIGN PATENT DOCUMENTS

| | | |
|---|---|---|
| 338209 | 8/1977 | Austria . |
| 376612 | 12/1984 | Austria . |
| 0056630 | 7/1982 | European Pat. Off. . |
| 20277481 | 8/1988 | European Pat. Off. . |
| 0390771 | 10/1990 | European Pat. Off. . |
| 0494339 | 7/1992 | European Pat. Off. . |
| 3335252 | 4/1984 | Germany . |
| 8809725 | 12/1988 | WIPO . |
| 9216308 | 10/1992 | WIPO . |

*Primary Examiner*—John Hilten
*Assistant Examiner*—Leslie J. Grohusky
*Attorney, Agent, or Firm*—Lorusso & Loud

[57] ABSTRACT

A process and apparatus is disclosed for cleaning a fluid substance from an application device with substance supply channels, and, if required, for cleaning a screen that surrounds the application device. The substance to be removed from the application device and, if required, from the screen, or a mixture of the substance and a cleaning fluid are forced away through the supply channels for the substance.

21 Claims, 3 Drawing Sheets

PROCESS AND DEVICE FOR CLEANING AN APPLICATION DEVICE

CROSS-REFERENCE TO RELATED APPLICATIONS

A claim of priority is made to U.S. Regular Utility application Ser. No. 08/693,159, filed Aug. 9, 1996, the contents of which are incorporated herein by reference. This is a continuation-in-part application of a regular utility application Ser. No. 08/693,159, filed Aug. 9, 1996, now abandoned, which is a continuation in part of application Ser. No. 08/532,634 which was filed as PCT application PCT/AT95/00030 on Feb. 13, 1995 and entered the U.S. national phase on Dec. 11, 1995 and which issued as U.S. Pat. No. 5,775,218 on Jul. 7, 1998 the contents of which are incorporated herein by reference.

BACKGROUND OF THE INVENTION

1. Field of the Invention

The invention refers to a process for cleaning an application device typically used in screen printing which has supply channels for a fluid substance. The invention is also suitable for cleaning a screen which may surround the application device.

2. Description of the Related Art

In textile printing, application devices which apply substances such as dyes to substrates must be cleaned. In the usual case, in order to clean the application device, the application device, including a rotary screen, if present, must be removed from a production or printing apparatus. Next, the production apparatus must be separated from the screen so that its outside surface can be rinsed and sprayed in a separate washing apparatus.

According to AT-B 338 209 and EP-A2 0 277 481, it is known to leave the application device during cleaning in a production or working position, whereby cleaning is effectuated by simply sending the cleaning substance through supply channels. It is suggested in one case that the cleaning fluid can be drained through the openings in the screen after the cleaning process. Because this approach is not practical, EP-A2 0 277 481 proposes an additional suction device which is installed over the total length of the application device to suction off the cleaning fluid.

SUMMARY OF THE INVENTION

Contrary to the known devices' respective processes, the present invention removes cleaning fluid from the application device by suctioning off the cleaning fluid mainly through the substance supply channels, after the cleaning process has been completed. By utilizing the substance supply channels as the conduit for delivering the cleaning fluid to the application device and screen, the substance supply channels are being flushed with the substance and the cleaning fluid in alternating directions, which increases the cleaning effect considerably.

A special advantage in the use of the invention, if so designed, is that at least one part of the cleaning substance, e.g., fluid, can be supplied through the supply channels which are necessary for feeding the substance during the production process. Such self cleaning application devices are of special interest in practice: the invention provides for the flushing of the supply channels of the substance applied to a substrate during the production process phase by sending the cleaning fluid in opposite directions in the supply channels. This reduces water consumption considerably and, contrary to the past suggestions, effectuates the removal of cleaning fluid after the cleaning process is secured, without the need for any additional design work or any additional components to the production apparatus.

The invention can also be used on application devices on which cleaning fluid is supplied independently from the distribution system for the application substance. It is also very efficient on application devices, according to the invention, to have such an additional distribution system in the application device. Such a configuration can perform the additional function of cleaning the inside of the screen and a high pressure squeegee element, if present.

Common cleaning of the rotary screen and the application device within a production apparatus is the final step of a complete process, consisting of the application process and the cleaning process. Therefore it is important to optimally arrange this complete process by taking into account the change between those two processes. This means that at first the economical use of the application substance must be manifested. The supply of the cleaning fluid through the application device is especially suitable if first the application substance is removed at least partially from the application device by any suitable method such as suctioning.

According to the present invention for cleaning an application device, in a preferred embodiment, the complete process comprises feeding the application substance during the production process or cycle, suctioning off in the reverse direction of the application substance's initial flow direction, at least one part of the unused application substance out of the application device, and thereafter supplying the cleaning fluid through the same conduits as the application substance for the washing process or cycle. If this process is supported by using suction air, water consumption is reduced.

An unexpected advantage of the invention is if the application device is used in the cleaning process phase for screen cleaning, the application device becomes more effective in its role during the production process phase of providing an evenly distributed supply of substance to an application area. To carry out the process of the present invention, it is therefore preferred to utilize an application device, which by design, is provided with a distribution system of channels, slots or conduits that end in a line of tubular outlets with a distance of 5–20 mm, a spacing that is independent of the length of the application device. The tubular inlets/outlets can also be connected to a slot to alter disbursement patterns. These and other objects and features of the present invention will be apparent from a review of the drawings and a reading of the following detailed description of the invention.

DESCRIPTION OF THE PREFERRED EMBODIMENTS

Figure 1A:
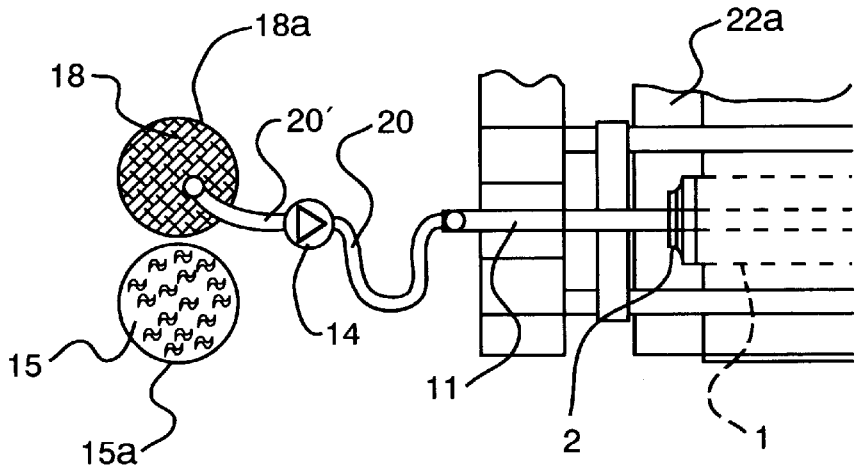
FIG. 1*a* is a segment of a production cycle of an application device according to one embodiment of the invention shown in plan view.

FIG. 1 shows the process of the present invention in use with a rotary screen printing device. The invention is, however, not limited to textile-type screen printing, but can also be used in connection with any application device related to a moving web.

The production apparatus shown in FIG. 1, has a rotary screen 1 that is tensioned with two end rings 2 and runs synchronized with support 22 for a web to be printed. Through the inside of screen 1, an application device 5 is situated, which comprises a distribution device for a substance such as dye to be applied and any kind of squeegee. As shown in FIGS. 2*a* and 2*b*, a roll rod 4 is pressed on the inside of the rotary screen 1 by a magnet bar 26 which is located under support 22, whereby the substance is pressed through the openings of the rotary screen 1 onto the web.

Figure 1B:
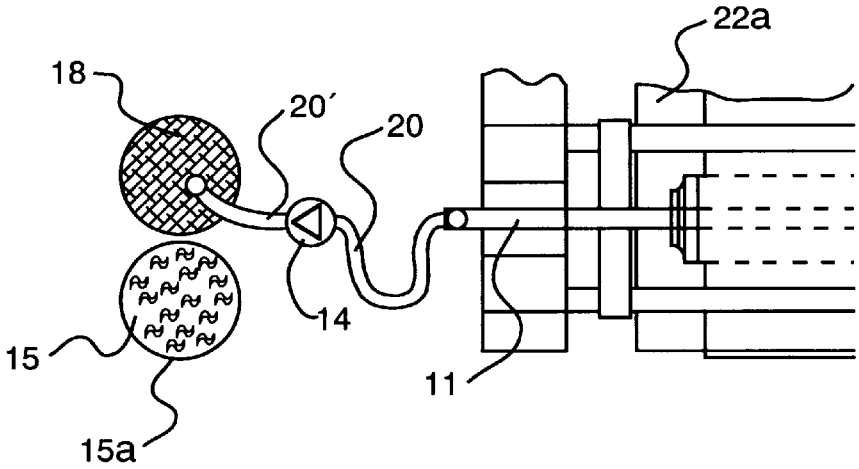
FIG. 1*b* is another segment of a production cycle of an application device according to one embodiment of the invention in plan view with a pump operating in a reverse direction.
Figure 2B:
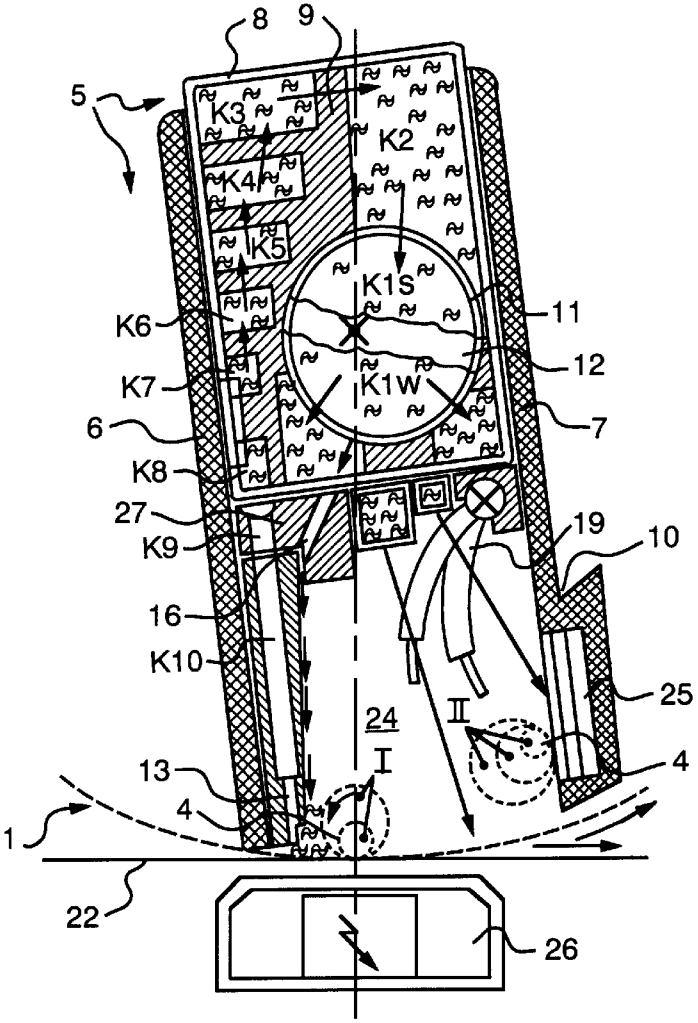
FIG. 2*b* is an elevational, sectional view of an application device in cleaning mode.
Figure 2A:
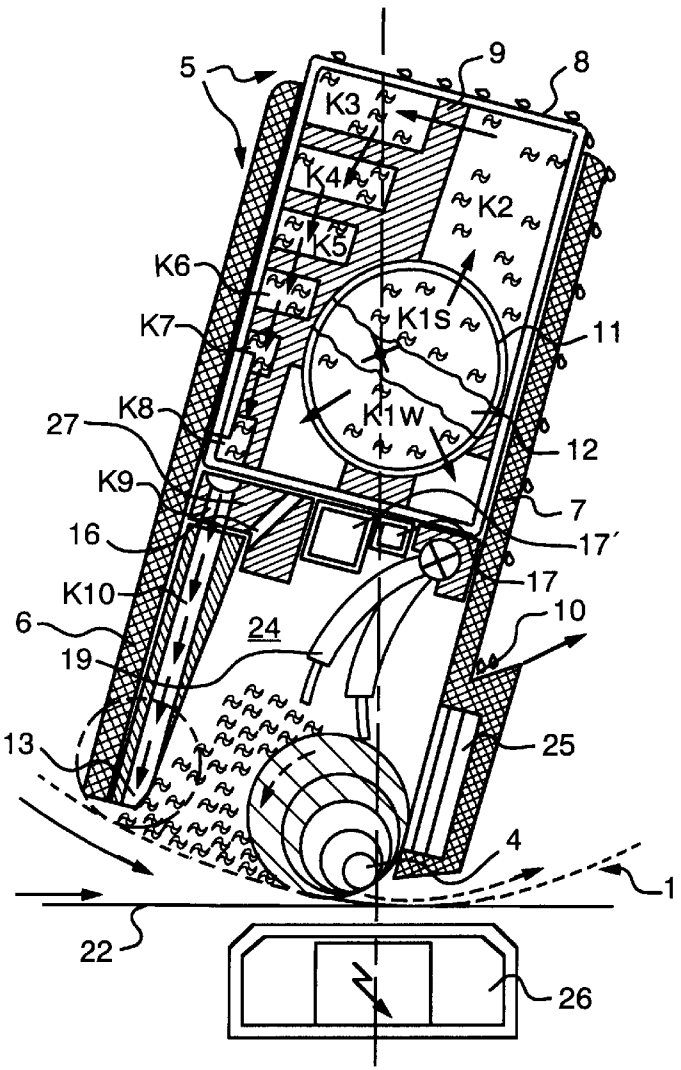
FIG. 2*a* is an elevational, sectional view of an application device in production mode.

In the actual production cycle according to FIG. 1*a*, a substance 18 is transported out of a storage container 18*a* with a pump 14 (preferably a hose pump), through hose sections 20' and 20 into application device 5. If rotary screen 1 and application device 5 are cleaned during permanent or momentary interruption of the production cycle, the direction of the pump 14 is reversed as shown in FIG. 1*b*, whereby the remaining substance in application device 5 is pumped back into storage container 18*a*.

Figure 1C:
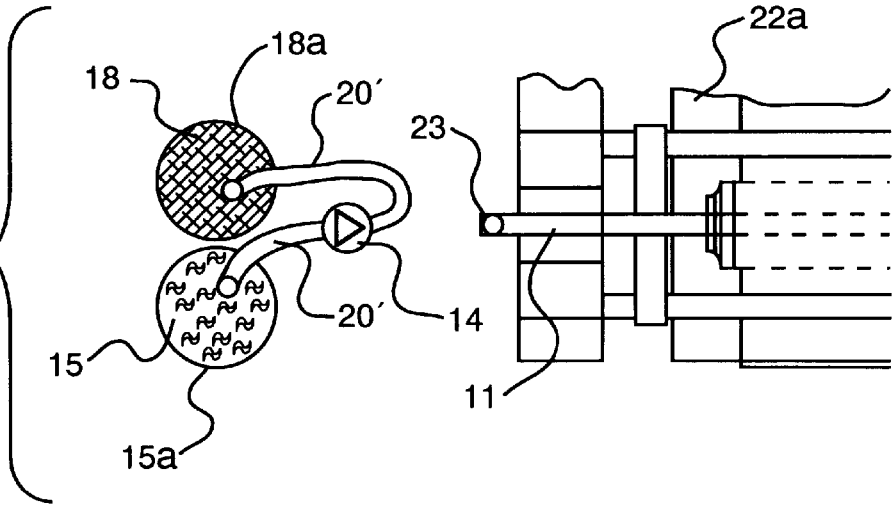
FIG. 1*c* is a further segment of a production cycle according to one embodiment of the invention which is an intermediate step of an application device in plan view.

As an intermediate step, as shown in FIG. 1*c*, after dismantling a hose coupling 23, water 15 can be suctioned off from a storage container 15*a*, whereby the application substance 18 in hose section 20, in pump 14 and in the main part of hose section 20' is forced through hose sections 20 and 20' and pump 14 away from storage container 15*a* and transported back into storage container 18*a*. At this intermediate point of the process, it has to be understood that this part of the process is short; either no or only a little cleaning fluid (water 15) enters substance storage container 18*a*. This process (cleaning process cycle of the complete process) can be optimized by using a compressible plug f.e. (not shown), made of foam rubber and placing it at the beginning of the hose section 20' that is distal from pump 14.

The plug intensifies the cleaning effect of the flowing substance by functioning like a sponge. In a preferred embodiment, hose pump 14 is adapted for use with the invention embodiment that utilizes the plug to thereby optimize the action of the total cleaning process. The cleaning components (sponge or similar element) pass and also clean therefore, through the process of the present invention, the hose pump and separate, at the same time, the application substance 18 from the flowing medium when the final step of the cleaning cycle has been completed as shown in FIG. 1*e*.

Figure 1D:
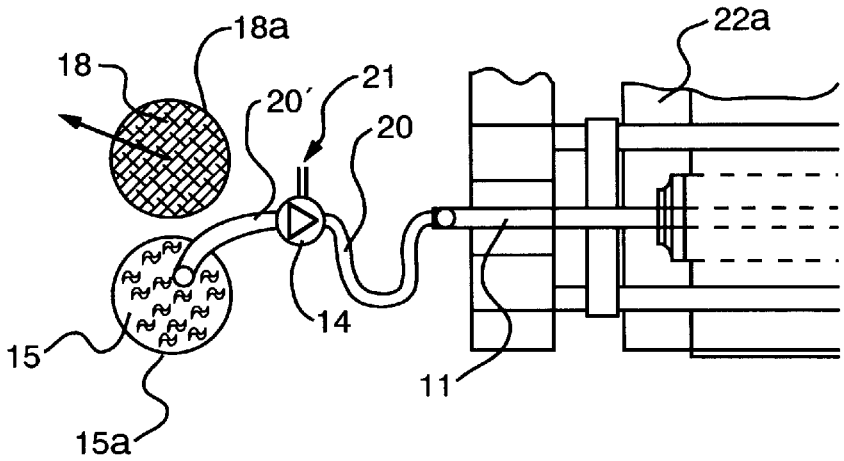
FIG. 1*d* is a segment of a cleaning cycle according to one embodiment of the invention of an application device in plan view.
Figure 1E:
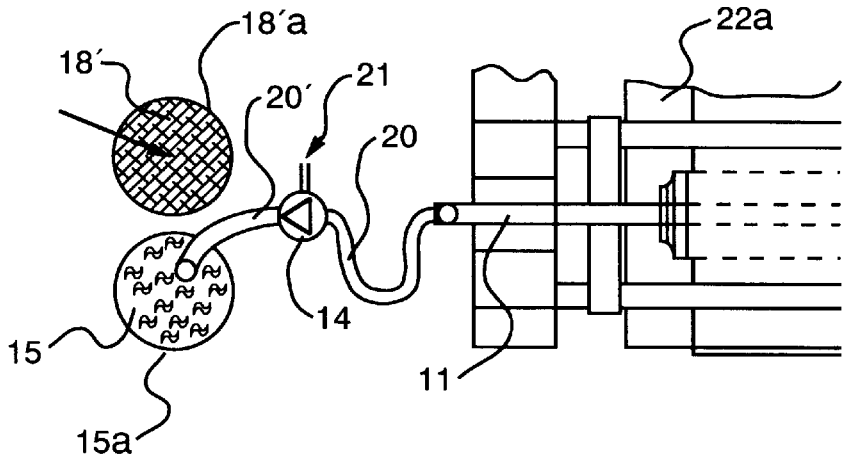
FIG. 1*e* is another embodiment of a cleaning cycle of an application device in plan view.

In FIG. 1*d* and 1*e*, the cleaning phase of the application device 5 and the rotary screen 1 is shown. The cleaning is carried out by forcing water 15 out of storage container 15*a* or out of a piping system by means of a pump 14 through the hose sections 20' and 20 into the application device 5. Simultaneously or alternatively, compressed air can be forced in as shown by arrow 21. This increases the cleaning effect by increasing the pressure at which water 15 is delivered in the production apparatus components such as the application device 5. By increasing the pressure of water delivery, the amount of water needed to adequately clean the system is reduced thereby rendering the cleaning process more efficient. In an alternate embodiment, the cleaning fluid, e.g., water, can also be introduced directly into application device 5 via connecting a dedicated hose from container 15*a* to hose coupling 23 (shown in FIG. 1*c*) which is attached to a pipe 11 which in turn, leads directly into application device 5. In this configuration, pump 14 is bypassed.

During the cleaning step, as shown in FIG. 1*d*, substance storage container 18*a* can be replaced by a container 18*a* (shown in FIG. 1*e*), which is filled with a different substance 18'. Substance 18 is forced out of container 18*a*, as shown in FIG. 1*d*, with any suitable means such as compressed air and, if necessary, simultaneously and additionally cleaning fluid, e.g., water 15, supplied into screen 1 via pipe 11 and application device 5 is suctioned out of application device 5 and possibly out of the existing rotary screen 1, with pump 14, in the next process step shown in 1*e*.

It is possible and suitable to often repeat the process steps shown in FIGS. 1*d* and 1*e*. The step shown in FIG. 1*d* can be supported by compressed air 21 each time.

In one embodiment, the cleaning fluid mixed with the application substance can also be carried away partially via transport belt 22*a* (shown in FIG. 1*a*). A main factor for this cleaning process is the substance-passing ability of rotary screen 1. The cleaning fluid mixed with the application substance, when it passes through rotary screen 1, is deposited on transport belt 22*a*. Operation of transport belt 22*a* after deposit of the mixture removes the mixture from the production apparatus in general and specifically from application device 5 and rotary screen 1.

The feeding of the cleaning fluid can be carried out with a pump out of a storage container as previously described. However, for example, it is also possible to get the cleaning fluid from a water line system. To remove the cleaning fluid, a suction pump or a suction ventilator can be used, that has a higher suction capacity than pump 14 operating in the reverse direction.

Application device 5 as shown in FIGS. 2*a* and 2*b*, is capable of suitably performing the bi-directional functions of the present invention. Beside performing the function or process cycle for applying substance such as dyes, the application device of the present invention is designed so that it can be cleaned completely or partially by using the same substance supply channels used to deliver the application substance. These substance supply channels can also be used especially for removing the cleaning fluid (mixed with application substance) which came, by whatever route, to the lower side of application device 5, through the supply channels described herein below.

The application device shown in FIGS. 2*a* and 2*b* includes a system for the application substance supply, which comprises a pipe 11 that is supplied with application substance from pump 14 (not shown), and hose coupling 23 (shown in FIG. 1*c*). Pipe 11 has an end opposite the end that joins hose coupling 23 that is located in a sheet metal housing 8, which includes a width distribution body 9. For example, as described in Austrian patent file 376 612 (Johannes Zimmer), body 9 divides the substance flow coming from pipe 11 (K1s), first into eight separating steps (K1s–K8), which are carried out inside housing 8.

In order to design an application device not only for the production process but also for the cleaning process, a distribution ledge 27 is attached to the bottom of the housing 8, which further distributes the substance flow so that the supply channels 13 for the substance have an equal distance between 5 and 20 mm in their meeting area, independently of how long the application device is. In FIG. 2*a* the ends in the supply channels 13 (K9 and k10), are shown separately. In FIG. 2*b*, a modification is planned on the actual outlet by means of a slot 13*a* or distance continuing the channels, which can ease the suctioning off of substance-laden cleaning fluids. For the number of channel dividing steps, the length relative to the application width is important in order to achieve the preferred embodiment distance of 5–20 mm.

For the actual application process or cycle, application device 5 in the embodiment shown in FIG. 2*a* has a magnetically attracted roll rod 4, which possible diameters are shown in FIGS. 2*a* and 2*b* as circles sharing a common perimeter point. When application device 5 is not in operation, roll rod 4 is held on the back side wall 7 of application device 5 with a permanent magnet 25. (shown as position II in FIG. 2*b*). During the application process, the force of magnet bar 26 is increased, so that roll rod 4 moves away from back side wall 7 and is pressed onto the inside of screen 1, in order to press the stored substance in front of the roll rod 4 through the openings of the screen 1 onto a web which is carried by a support 22.

The invention is not limited to the disclosed application process. For example, the application can also be carried out with a blade squeegee, especially a magnetically attracted blade squeegee. The squeegee device can be used as an alternative to the roll rod and would be located and moved as the roll rod is described to be located and moved in the preceding paragraph. The squeegee device may be a blade squeegee. Together with the back side wall 7 and the housing 8, a hollow space 24 open to the bottom, is formed by a front side wall 6, in which the substance and the cleaning liquid are being stored.

In FIG. 2*a*, the application device is shown in production position, whereby the arrows are showing the flowing directions of the substance to be applied, from pipe 11 to the inside of the hollow space 24. It is essential that the substance supply channels 13 meet as near as possible at the bottom edge of the hollow space 24, in order to suction off not only the remaining application substance, but also cleaning fluid which has been previously supplied and not forced through screen 1 with roll rod 4.

FIG. 2*b* shows the application device in tilted position, preferably for cleaning. When roll rod 4 is in position I, the cleaning fluid is pushed together into the area at a distal end of supply channels 13, which improves the suction effect. In a position according to FIG. 2*a*, almost the entire width of hollow space 24 is available for substance storage. To support the cleaning process, the attraction of roll rod 4 by magnet bar 26 (position I) can be increased relative to the attraction of roll rod 4 by permanent magnet 25 (position II) while in the position shown in FIG. 2*a* to force the cleaning fluid into close proximity with the distal end of supply channels 13 by rolling against screen 1.

To supply cleaning fluid to hollow space 24, the system shown in FIG. 2*a* can be used in the same way as for the supply of substance to be applied. Additionally or alternatively, cleaning fluid can be supplied into the hollow space 24 through pipes 16,17,17'. These pipes can be connected to a water feeding system as desired. A very convenient embodiment of this invention is shown in FIG. 2*b*—pipe 11 is lengthwise separated by a wall 12, whereby pipe hollow spaces are laid out on both sides of wall 12 with, attached to one pipe hollow space, pump 14, another pump or a suction device, and attached to the other pipe hollow space , a source for the cleaning fluid (K1w), which at the end flows into the pipes 16,17,17' via channels between pipe 11 and pipes 16,17 and 17'.

The pipes 17 and 17' can be connected on one end because of liquid flow characteristics. Exit openings can be used, as shown in FIGS. 2*a* and 2*b*, in a variety of combinations such as, for example, one line of holes in each of the two pipes, one line of holes in only one of the two pipes or two lines of holes in one of the two pipes, etc, The supply of cleaning fluid to application device 5 can be done either solely by pipes 16,17,17', solely by the supply system for the application substance, or by both systems. During the complete cleaning process, a change between these alternatives can be accomplished, each alternative offering specific advantages—the cleaning fluid supplied over pipes 16, 17, 17' enters the inside of screen 1 with respect to roll rod 4, in an almost completely clean condition, whereby the cleaning fluid which enters the hollow space 24 over the substance supply system, is already being mixed with remaining substance in the substance distribution system. Because outlet pipe 16 is designed as a wide slot nozzle, it is specially suitable for cleaning the front limiter of hollow space 24, whereby jets coming out of the individual openings of the pipes 17, 17' can clean the back limiters of the hollow space 24 as well as roll rod 4 which is located therein. Outlet pipe 16 can have a sectional shape configured in the shape of an elongated slot or a cylindrical, square or rectangular pipe.

Essential for the invention is that the suctioning off of the cleaning fluid out from hollow space 24 is done by the same system through which the application substances is supplied, provided the cleaning fluid does not also run out partially through screen 1. Cleaning fluid is prevented from running out through screen 1 due to the tight mesh of screen 1 and the viscosity of the application substance/cleaning fluid mixture. Any small amounts of the mixture that do pass through screen 1 are transported away via transport belt 22*a*.

This system not only leads to optimal cleaning of the substance distribution system while saving water, but also allows the feeding of the substance and the suctioning off of the cleaning fluid with one and the same pump 14. Due to this, the application device no longer needs to be equipped with an additional suction device.

The embodiment of application device 5, shown in FIGS. 2*a* and 2*b*, can be changed in various ways. Furthermore, some of the details shown in FIGS. 2*a* and 2*b* are useful, but not necessary. Therefore it is an advantage to control the cleaning process over a turntable (not shown) and, if necessary, over a lengthwise movable level feeler 19 that remains stationary due to gravity regardless how application device 5 is rotated. Rotation of application device 5 (as shown in FIG. 2*b*), causes movable level feeler 19 to be in close proximity to back wall 7. When sufficient application substance is present in application device 5 so that level feeler 19 comes into contact with the application substance, sensors situated within level feeler 19 either provide indication of the need for instituting a cleaning cycle or trigger an automated cleaning cycle if automatic control is present to which level feeler 19 is attached.

Level feeler 19 could also be replaced by a pressure measuring unit (not shown) which is located in the wall of hollow space 24. This is especially pertinent if the space arrangement of the application device is changed, as for example for application onto the bottom side of a horizontally guided web. The process itself can be varied with regard to procedure and timing of the individual steps, whereby it is possible to control the process manually or with a computer.

By supplying compressed air, application device 5 is dried on the inside, but not on the outside. In the event the application device is being used for another application process after the cleaning process, without being taken out of the screen, water drops, apart from the other cleaning fluid dropping off the back wall 7, can cause damage. To avoid this, back wall 7 is laid out with a small groove 10, in which the liquid drops, remaining on the upper or backside of the device surface after the cleaning process, and those that have flowed to the bottom due to gravity, are collected. This step, avoiding application process mishaps caused by liquid remainders which could drop onto the screen, can also be accomplished on wall 6.

To avoid the dropping of substance which gets to the top on the inside of the screen, when the printing device is lifted and the screen is slowly turned after the printing process is finished or interrupted, only the magnet field is switched off before lifting. Due to this, the roll rod will be moved by the screen from position I into position II. If the screen turns at least one full turn, the wall 7 is used as a split squeegee, which applies the substance in a kind of a split squeegee coating onto the inside wall of the screen, in a substance thickness according to the distance to the screen.

A layer evened this way, therefore, cannot drop down or penetrate any further into the screen. After this interruption, the substance application production can be carried on, or a washing cycle can be carried out, in the printing machine or in a separate washing machine, without substance dropping on the upperside of the application device which would have to be removed later with a separate cleaning process. This is an important step extending the main function of the invention.

The invention has been described on the basis of a rotary screen printing device, however, it can also be used for flat screen printing devices that utilize application processes including direct application of substance onto a web.

Having thus described my invention, what I claim as new and intend to secure by United States Letters Patent is:

1. An apparatus for the application of a substance to a substrate through a screen in which the substance is periodically removed by infusion and withdrawal of a cleaning fluid comprising:

a channel capable of fluid communication with a reversible pump, said channel being capable of fluid communication with both a source of the substance and the cleaning fluid;

an applicator in fluid communication with said channel for delivering substance when in said channel to a screen or template;

a reversible pump adapted to deliver substance to said applicator and remove substance from said applicator, deliver cleaning fluid to said applicator and remove cleaning fluid and substance from said applicator;

the combination of said channel in fluid communication with the sources and said applicator and said reversible pump enabling a single channel to both deliver the substance and the cleaning fluid to the screen and remove both substance and cleaning fluid from the apparatus.

2. The apparatus according to claim 1 wherein a groove is located on an outside surface of said applicator to drain a liquid.

3. The apparatus of claim 1 wherein said applicator further comprises a pipe which is divided in a longitudinal direction to form first and second pipe cavities wherein the substance and cleaning fluid are supplied and a mixture thereof is suctioned off via the first pipe cavity while simultaneously cleaning fluid is supplied and transported through the second pipe cavity.

4. The apparatus according to claim 1 further comprising additional channels each in fluid communication with said reversible pump and each being capable of fluid communication with both the source of cleaning fluid and the source of substance.

5. The apparatus according to claim 4 further comprising a cavity wherein said cavity is in fluid communication with said channels and with a bottom opening of said applicator.

6. The apparatus of claim 4 wherein said channels are connected to each other to form a slot.

7. The apparatus according to claim 5 further comprising at least one pipe in fluid communication with said channels and said cavity.

8. The apparatus according to claim 7 wherein an outlet of said at least one pipe further comprises small holes located in close proximity to each other and adjacent to a front wall of said cavity.

9. The apparatus according to claim 8 wherein a magnetically attractable roll rod is situated in said cavity.

10. The apparatus according to claim 9 further comprising a movable level feeler which reaches into said cavity.

11. The apparatus according to claim 10 wherein said applicator is tiltable around a longitudinal axis and is held in a tilted position whereby during a cleaning process the roll rod provided in said cavity of said applicator and in contact with the screen collects the cleaning fluid in said channel by rolling against the screen toward a low point of said cavity.

12. The apparatus according to claim 9 further comprising a squeegee device having a back wall wherein said back wall of said squeegee device is displaced from an inside surface of the screen wherein the screen is a rotary screen whereby relative movement of the rotary screen and said applicator provides a storage which remains in the screen and can be distributed over an entire inner surface of the rotary screen.

13. A method of applying a substance to a substrate comprising:

providing a substance to a channel and delivering it to an applicator;

applying substance through a screen or template onto a substrate;

reversing the flow of substance;

introducing cleaning fluid through the channel in the direction from a source toward the applicator;

reversing the flow to remove cleaning fluid and substance from the channel to clean the applicator and channel for reuse.

14. The process according to claim 13 wherein reversing the flow to remove cleaning fluid and substance from the channel to clean the applicator and channel for reuse also cleans the screen or template for reuse.

15. The process according to claim 13 wherein the substance is dye.

16. The process according to claim 13 wherein the substrate is textile.

17. The process according to claim 13 wherein the substance is delivered from a source through the channel to the applicator with a pump and wherein the reversal of the flow and removal of cleaning fluid is accomplished by reversing the flow of the pump.

18. The process according to claim 13 wherein the step of introducing cleaning fluid further comprises supplying cleaning fluid with a piping system to said applicator, and mixing the cleaning fluid with the substance to form a mixture and, wherein the step of reversing the flow to remove cleaning fluid and substance further comprises draining the mixture through a suction device.

19. The process according to claim 13 wherein the step of reversing the flow of substance suctioning off the substance from the applicator into a storage container before providing a cleaning fluid.

20. The process according to claim 13 further comprising the step of supplying a roll rod within said applicator and, switching said applicator from a production mode to a cleaning mode wherein during said cleaning process said roll rod is moved relative to said applicator.

21. The process according to claim 13 wherein automatic controls switch the application between a production mode and a clean mode.

* * * * *